United States Patent [19]

Andersson et al.

[11] 4,210,290

[45] Jul. 1, 1980

[54] METHOD AND APPARATUS FOR CONTROLLABLY SUPPLYING MATERIAL TO A ROD MILL IN ACCORDANCE WITH POWER CONSUMPTION OF THE ROD MILL MOTOR

[75] Inventors: Roy E. P. Andersson; Jan A. Bohm, both of Gallivare, Sweden

[73] Assignee: Boliden Aktiebolag, Stockholm, Sweden

[21] Appl. No.: 940,285

[22] Filed: Sep. 7, 1978

[30] Foreign Application Priority Data

Sep. 13, 1977 [SE] Sweden ..... 7710256

[51] Int. Cl.[2] ..... B02C 17/00; B02C 25/00

[52] U.S. Cl. ..... 241/30; 241/34

[58] Field of Search ..... 241/30, 34, 35

[56] References Cited

U.S. PATENT DOCUMENTS

| | | | |
|---|---|---|---|
| 2,240,822 | 5/1941 | Adams | 241/30 |
| 2,336,434 | 12/1943 | Wurzbach | 241/30 |
| 3,773,268 | 11/1973 | Bond | 241/30 |
| 3,856,214 | 12/1974 | Kaltenbach et al. | 241/34 |
| 4,123,009 | 10/1978 | Kilpinen | 241/30 |

*Primary Examiner*—Richard B. Lazarus

*Attorney, Agent, or Firm*—Stevens, Davis, Miller & Mosher

[57] ABSTRACT

In the operation of a grinding plant, including a motor-driven rod mill and an arrangement for controllably supplying material to be ground to the rod mill, the supply of material to the mill is adjusted in a manner such that the power consumption of the mill motor is maintained substantially constant at a value which exceeds the power consumption of the mill motor at the occurrence of a rod-jam by approximately 0.5–2%.

5 Claims, 1 Drawing Figure

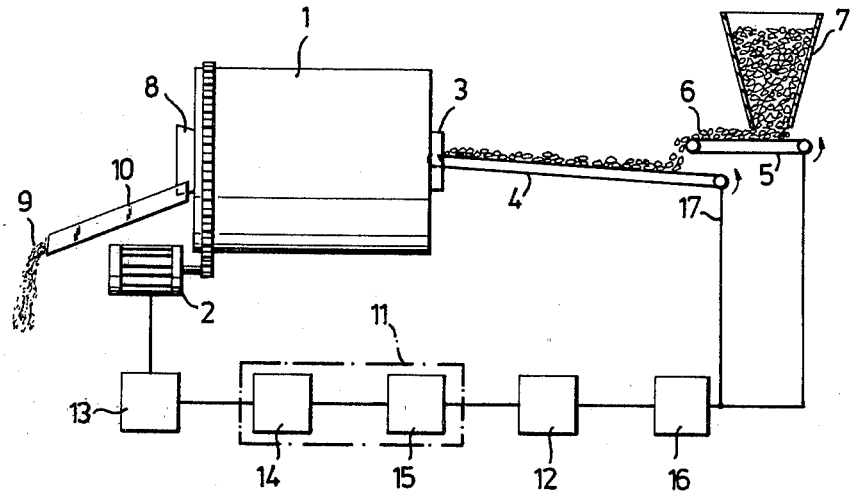
1
7
8
3
6
10
5
9
4
17
2
11
13
14
15
12
16

METHOD AND APPARATUS FOR CONTROLLABLY SUPPLYING MATERIAL TO A ROD MILL IN ACCORDANCE WITH POWER CONSUMPTION OF THE ROD MILL MOTOR

The present invention relates to a method of operating a grinding plant of the type including a motor-driven rod mill and an arrangement for controllably supplying material to be ground to the rod mill. The invention also relates to a grinding plant. for carrying out the novel method.

A rod mill is a continuous-flow mill which is normally used to coarse grind the material while charging water to the mill, for example for grinding ore from lump-sizes of approximately 35–50 mm to a particle size of approximately 1–3 mm. The rod mill comprises a substantially horizontal, rotatable grinding drum having a central inlet for material to be ground in one end wall of the drum and a central outlet for ground material in the other end wall thereof, the drum having arranged therein a plurality of mutually separated rods which extend parallel to one another and which, as the drum rotates, exert a grinding or crushing action on the material to be ground. The grinding drum is normally provided with longitudinally extending lifters and is normally relatively long in comparison to its diameter, in order that the rods shall remain oriented substantially parallel with the drum axis and with each other.

When grinding in a rod mill, it must be ensured that so called rod-jam is avoided, i.e. a disorientation of the rods so that the grinding rods are no longer parallel with one another, but take random positions in which they lock each other and the material being ground, which renders it impossible to continue the grinding operation, since the rods and the material accompany the drum in its rotation. The work involved in emptying the drum subsequent to such disorientation of the rods is particularly time consuming and strenuous, since the rods must be removed and the material shovelled out from the drum, which to a large extent must be effected manually. When the rod mill forms part of a complete ore-processing plant, for example, a breakdown in operation resulting from a rod-jam can also necessitate stopping of the operation of crushers located upstream of the rod mill, and the operation of ball mills etc. downstream of said mill. Rod-jam develops very quickly, usually within a time period of one minute. Forwarning before the occurence of a rod-jam is given by the fact that the mill begins to discharge lumps of unground or partially ground material, and hence the feed to the rod mill is normally adjusted so that such lumps are not discharged from the mill. The mill begins to discharge such partially ground lumps of material long before there is any danger of rod-jam and long before the grinding capacity of the mill is utilized to the fullest, and hence control of a rod mill by lowering the supply of material thereto immediately when it begins to discharge unground material results in a high loss of grinding work. When there is required a specific particle size distribution of the ground material, it may be necessary to operate at an even lower feed rate at which no unground or partially ground material is discharged from the mill.

When the rod mill forms part of crushing and grinding system comprising e.g. a crushing stage before the rod mill and a grinding stage, e.g. a ball mill, after the rod mill, the particle size distribution of the material which has been ground in the rod mill is not particularly critical, since e.g. a ball mill operates excellently well with material within a relatively large region of particle sizes.

The object of the present invention is to provide automatic control of a grinding plant comprising a motor-driven rod mill and an arrangement for controllably supplying material to be ground to said rod mill, which control, without danger of the occurrence of rod-jams results in a throughput which significantly exceeds the throughput attainable with conventional control techniques.

To this end it is suggested in accordance with the invention to adjust the supply of material to be ground to the rod mill in a manner such that the power consumption of the mill motor is maintained within a region which exceeds the power consumption of the mill motor at the occurrence of a rod jam by approximately 0.5–2%. By proceeding in this manner, i.e. by using for control purposes a small downwardly sloping portion of the power consumption curve of the mill motor, which curve portion is proceeded by a substantially horizontal curve portion unusuable for control purposes and followed by a substantially downwardly directed curve portion, there is obtained a reliable control of the grinding process while utilizing the grinding capacity of the rod mill practically to a maximum. Although a minor quantity of the material charged to the mill will pass therethrough without being ground, or with only being partially ground, which material will have to be re-ground, the disadvantage herewith is small compared with the advantage afforded by the fact that the mill will constantly operate with a substantially maximum throughput while discharging a ground material excellently well suitable for continued grinding in e.g. a ball mill. Practical tests carried out on factory scale have shown that an increase in capacity in the order of at least 20–25% can be obtained.

The exact value of the power consumption of the mill motor when rod-jam occurs can be established in each given case, by the combination of accurately measuring the power and observing the grinding process.

As beforementioned, the invention also relates to a grinding plant for carrying out the method according to the invention. This grinding plant, which comprises a motordriven rod-mill, means for sensing the power consumption of the mill motor, and an arrangement for controllably supplying material to be ground to the rod mill, is characterized in that it comprises a regulator which operates in dependence upon the sensed power consumption and which is arranged to adjust the said supply arrangement in a manner such that the power consumption of the mill motor is maintained within a region which exceeds the power consumption of the mill motor at the occurrence of a rod-jam by approximately 0.5–2%.

The invention will now be described with reference to the accompanying drawing, further characteristic features and advantages of the invention being disclosed in conjunction therewith. The drawing illustrates schematically a grinding plant incorporating an exemplary embodiment of an apparatus for carrying out the method according to the invention.

In the drawing there is illustrated a rod mill 1 intended for wet-grinding and driven at a constant rotary speed by means of a motor 2. The rod mill 1 has an inlet 3 through which material 6 to be ground is charged to the mill from a hopper 7 by means of endless conveyors 4 and 5, and an outlet 8 through which material 9 ground in the mill is discharged therefrom and carried away by means of a chute 10. Of the aforementioned conveyors, at least the conveyor 5 is regulatable with respect to the conveyor speed and constitutes, at the same time, in a known manner a weighing device by which the material 6 charged to the mill is continuously weighed and the quantity of material charged to the mill per unit of time can be adjusted to any desired value.

The reference 11 identifies a signal transducer which converts a signal received from the mill motor 2, said signal corresponding to the power consumption of said motor, to a control signal corresponding to said power consumption and suitable for controlling a regulator 12. Cooperating with the signal transducer is a damping device 13 arranged to prevent momentary oscillations in the control signal emitted by the signal transducer. In the illustrated embodiment, the signal transducer 11 includes a device 14 which receives the signal arriving from the mill motor and dampened in the device 13, and transmits to a filter and amplifying stage 15, also incorporated in the signal transducer 11, a signal proportional to the power consumption, said signal being, for example, in the form of an electric current or voltage, which stage will only allow to pass therethrough that part of the signal from the device 14 which corresponds to the upper power consumption region of the mill motor 2, and amplifies this part of the signal in a manner such that changes in the power output of said motor are clearly evident from the control signal applied to the regulator 12. The damping device 13 can be placed before or after the amplifying stage 15 instead of before the signal transducer 11.

The regulator 12 controls the weighing conveyor 5 via a second regulator 16. The regulator 12 is adjustable such that it sends a control signal to the regulator 16 in dependence upon the deviation of the signal from the signal transducer 11 from a desired set-point value for the power consumption of the mill motor 2, this value being adjustable by setting the regulator 12. This set-point value is placed at between 0.5 and 2% above the established power consumption of the motor at the occurrence of rod-jam. The occurrence of such deviations from the set-point value depend mainly upon changes in the grindability of the material 6 charged to the mill. The regulator 16 has adjustably set thereon an original set-point value corresponding to the desired quantity by weight of material 6 delivered by the weighing conveyor 5 per unit of time, this desired quantity of material 6 corresponding to the set-point value set on the regulator 12, the regulator 16 being designed in a manner such that, when the power consumption is equal to the set-point value on the regulator 12, it increases or decreases the rate of travel of the conveyor 5 in proportion to changes in the weight sensed by the conveyor 5, so that the supply of material corresponds to the set-point value set on the regulator 12 irrespective of any variations in the quantity of material taken from the hopper 7. The control signal from the regulator 12 is caused to act on the set-point value setting of the regulator 16 in a manner such that the set-point value originally set on the regulator 16 is changed in given adjustable proportions to any change in the control signal received from the regulator 12, so that the power consumption is maintained substantially constant, by increasing the set-point value for the supply of material to the mill proportionally to an increase in the power consumption of the mill motor and decreasing said value proportionally to a decrease in said power consumption.

To ensure against the occurrence of a fully developed rod jam and also to provide a simple means for determining the power consumption of the mill motor 2 when a rod-jam starts to develop, the grinding plant can also incorporate means for totally stopping the supply of material to the mill. Said means may be adapted to automatically stop the supply of material, should the power consumption suddenly fall, for example to the value lying between 2 to 3% below the set-point value on the regulator 12. In this way the conveyor 4 is also stopped, as indicated by lines 17, although a suitable water supply is maintained for facilitating the removal of surplus material from the mill.

When applying the invention in practice in conjunction with the wet-grinding of copper ore, which had a mean particle size of approximately 40 mm, in a rod mill, whose motor permitted a maximum power consumption of 600 kW, there was generated in a power transducer, operating in dependence upon the power concumption, a signal porportional to said power consumption, which signal varied from 0 to 20 mA for a variation in the power consumption of from 0 to 600 kW. Momentary oscillations in amplitude in the signal were filtered out in a filter for damping purposes. Of the thus damped signal, the part of the signal reaching above 16 mA was amplified to form a control signal, which varied from 0 to 20 mA with variations in power consumption of the mill motor from 480 to 600 kW. This control signal was used to control a first PI-regulator (proportionally integrating regulator), which was used in the manner described with reference to the regulator 12 in the drawing for controlling a further PI-regulator in the manner described with reference to the regulator 16 shown in the drawing. In the operation of the mill, the first PI-regulator was set to a set-point value for the power consumption of the mill motor of 556 kW, the supply of ore during the automatically controlled operation of the mill reaching, on average, to 260 tons per hour. The power consumption of the mill motor when rod-jam started to develop had been established at 552 kW power consumption and an ore supply of 270 tons per hour. When operating the same mill under conventional conditions without controlling the mill in accordance with the present invention, the average through-flow of ore was 186 tons per hour, a maximum through-flow of 220 tons of ore per hour could be obtained at times when constantly supervising the mill.

The invention is not restricted to the described and illustrated embodiments, but can be modified within the scope of the following claims.

We claim:

1. A method for operating a grinding plant of the type including a motor-driven rod mill and a means for controllably supplying material to be ground to said rod mill, comprising the step of adjusting the supply of material delivered by said means by increasing the supply of material upon an increase in the power consumption of the mill motor and decreasing the supply of material upon a decrease in the power consumption of the mill motor such that the power consumption of the mill motor is maintained within a region which exceeds the power consumption of the mill motor at the occurrence of a rod jam by approximately 0.5–2%.

2. A grinding plant comprising a motor-driven rod mill, means for sensing the power consumption of the mill motor, controllable means for controllably supplying material to be ground to the rod mill, and a regulator which operates in dependence upon the power consumption sensed by said sensing means for adjusting said controllable means by increasing the supply of material upon an increase in the power consumption of the mill motor and decreasing the supply of material upon a decrease in the power consumption of the mill motor such that the power consumption of the mill motor is maintained within a region which exceeds the power consumption of the mill motor at the occurrence of a rod-jam by approximately 0.5–2%.

3. A grinding plant according to claim 2, further comprising that a signal transducer for sensing a signal corresponding to the power consumption of the mill motor and for converting said signal to a corresponding control signal for said regulator, said regulator including means for emitting a control signal to said controllable supply means upon deviation of said control signal from a signal corresponding to a set-point value selected within said power consumption region.

4. A grinding plant according to claim 3, wherein said signal transducer emits a control signal corresponding only to the upper power consumption range of the mill motor.

5. A grinding plant according to claim 3 or 4, further comprising a damping means for preventing momentary oscillations in the control signal provided by the signal transducer.

* * * * *